106-15.05 SR
12/23/80 XR 4,240,496

United States Patent [19]
El Gammal

[11] 4,240,496
[45] Dec. 23, 1980

[54] HEAT-INSULATING ARTICLES

[75] Inventor: Tarek El Gammal, Aachen, Fed. Rep. of Germany

[73] Assignee: Foseco Trading A.G., Chur, Switzerland

[21] Appl. No.: 43,744

[22] Filed: May 30, 1979

[30] Foreign Application Priority Data

May 30, 1978 [GB] United Kingdom ..... 24480/78

[51] Int. Cl.³ ..... B22C 3/00
[52] U.S. Cl. ..... 164/138; 106/15.05; 106/38.22; 164/33; 249/106; 249/111; 249/197; 252/62; 264/338
[58] Field of Search ..... 106/38.22, 15.05; 249/106, 111, 197; 264/338; 164/33, 138; 252/62

[56] References Cited

U.S. PATENT DOCUMENTS

| | | | |
|---|---|---|---|
| 2,729,856 | 1/1956 | Horton et al. | 241/68 |
| 3,759,724 | 9/1973 | Nishi et al. | 106/38.22 |
| 4,012,262 | 3/1977 | Patterson | 249/197 |
| 4,042,206 | 8/1977 | Matsuyama | 249/197 |

FOREIGN PATENT DOCUMENTS

| | | |
|---|---|---|
| 977191 | 12/1964 | United Kingdom . |
| 1278473 | 6/1972 | United Kingdom . |

*Primary Examiner*—Lorenzo B. Hayes
*Attorney, Agent, or Firm*—Cushman, Darby & Cushman

[57] ABSTRACT

The invention provides shaped, refractory, heat-insulating articles, for use in a metallurgical vessel, comprising particulate refractory material, binder and particulate de-fibred bagasse or the like. The articles may be made by mixing the ingredients, pressing them in a former and causing or allowing the binder to set. The articles may be slabs for lining the head of a mould for steel ingots.

7 Claims, No Drawings

HEAT-INSULATING ARTICLES

The present invention concerns heat-insulating articles, particularly for use in metallurgical industry.

To restrict loss of heat from molten metals, heat-insulating and/or exothermic materials are widely used in the metallurgical industry. For example, the head metal in a mould such as an ingot mould or in a separate head box of such a mould may be surrounded by a so-called hot-top lining in the form of a sleeve or slabs of heat-insulating and/or exothermic material. Also, the top surface of molten metal in a metallurgical vessel may be covered by a board or boards of heat-insulating and/or exothermic material, such boards being known as anti-piping boards in the case of ingot moulds. Such boards may also be used to cover the upper metal surface in tundishes and the sides and bases of tundishes may be lined with heat-insulating and/or exothermic boards.

According to the present invention a shaped, refractory, heat-insulating article for use in a metallurgical vessel comprises particular de-fibred bagasse or the like, a particulate refractory material and a binder.

Certain plants have stalks that have an outer shell of fibrous material enclosing a high proportion of sap-containing tissue, i.e. pith, in the form of cells having thin, soft walls. Sugar cane is an example of such a plant, maize is another and there are more examples in the graminae, saccharum and achillea sub-families. In obtaining sugar from sugar canes, the canes are crushed, the sugar-containing sap in the pith extracted and the residue is known as bagasse. In this specification by 'bagasse or the like' is meant crushed or otherwise broken down stalks of pith-containing plants from which sap has been extracted or which have been dried. In addition to plants of the types just mentioned, certain woods, especially woods from deciduous trees, are also suitable.

The term 'de-fibred' means that a substantial proportion of the fibrous matter, e.g. from the outer shell of the stalks, has been removed from the bagasse or the like. Interspersed in the pith of sugar cane are bundles of fibres generally aligned with the cane and these form a relatively small proportion of the volume of the inner part of the cane and may be present in their original proportion or, preferably, in a reduced proportion in de-fibred bagasse usable in the invention. De-fibred bagasse or the like may be made in the manner described in U.S. Pat. No. 2,729,856. By this means the product is obtained in the desired fine particulate form and can be sieved to any desired particle size. The de-fibred material may be obtained very inexpensively as bagasse itself is basically a waste product and it is the fibrous portion that has usually been valued e.g. in paper making. In general dry hammer-milling provides a convenient way of breaking down the bagasse or the like so that it may readily be de-fibred.

The de-fibred material is highly porous and of very low bulk density e.g. about 0.085 g/cc. In contrast the bulk density of sawdust is about 0.2 g/cc. In accordance with the invention it has been found that the material is a very efficient thermal insulator and permits the production of low density, e.g. less than 0.7 g/cc, articles having excellent heat-insulating properties. It is throught that the good insulation properties are not only related to the high porosity of the defibred bagasse or the like but also to the generally small size of the pores.

The particulate refractory material may be one conventionally used in products of the general type in question and mixtures of two or more such materials may be used. Preferably the refractory material is sand, silica, quartz, chamotte (grog), olivine, sillimanite, magnesia, lime, calcined dolomite, clay, zircon, chromite, alumina or an aluminosilicate. The refractory material is preferably powdery or granular, preferably with an average grain size up to 0.3 mm, but some or all of it may be fibrous e.g. aluminosilicate fibres. Inorganic fibres of limited refractory properties e.g. glass wool and slag wool may also be included. Some or all of the refractory material may be lightweight e.g. expanded perlite or calcined rice husks.

In addition to the particulate de-fibred bagasse or the like the product may contain other organic fillers, which may be fibrous e.g. paper fibres or wood pulp, or granular e.g. sawdust.

The binder may be organic e.g. starch, a resin such as a urea-formaldehyde or phenol-formaldehyde resin or it may be inorganic e.g. bentonite or a silicate such as sodium silicate. A mixture of binders may be used. The binder used should be compatible with the other ingredients of the article; for example, a resin to be hardened by use of an acid should not be used as binder if the particulate refractory material is a basic one such as magnesia.

Articles of the general type in question have usually been made by the filtration of aqueous slurries in permeable moulds because, although this has disadvantages, other techniques were not practicable. Slurry techniques are not used in the present invention and the articles can readily be made by mixing the ingredients including a binder that will set at low temperatures e.g. room temperature, forming the mixture into the desired shape and causing or allowing it to set. If a resin binder is used this may be caused to set at room temperature by use of a catalyst, usually acidic, whilst if sodium silicate is used this can be made to set by the action of carbon dioxide. Alternatively, binders may be used which can be set by heating to a low temperature. Until the binder is set, the mixture is preferably maintained under pressure.

To facilitate forming the mixture to the desired shape and/or to reduce the density of the final article, liquid in the mixture may be foamed thereby assisting properly filling the former used and, if the foam is not collapsed before the binder sets, yielding a product having some foam structure and therefore a reduced density.

The proportions of the ingredients may be varied widely, the de-fibred bagasse or the like forming e.g. up to 50% of the weight e.g. 1 to 30%, preferably at least 5%, the refractory material forming e.g. 50 to 90% of the weight and the binder 1 to 20% of the weight e.g. 3 to 10%. For given materials, selection of particular proportions enables the strength, heat-insulating and other properties of the articles to be controlled. Typically the article will contain 10% binder, 20% bagasse and 70% particulate refractory material.

Exothermically reacting materials may be included in the ingredients of the articles. Preferably such exothermically reacting materials include an easily oxidised metal, e.g. aluminum, magnesium or their alloys, in particulate form, and a solid oxidising agent, e.g. iron oxide and/or manganese oxide or a metal nitrate, in particulate form. When aluminum is included it is preferred also to include an inorganic fluoride e.g. cryolite.

The articles may be in the form of sleeves for lining ingot mould heads or headboxes or casting mould risers, rings for placement at the base of ingot mould headboxes or, preferably, slabs or boards, especially for lining mould heads or headboxes for steel ingots.

Metallurgical vessels equipped with articles according to the invention form a part of the invention as does the use of the equipped vessels.

The invention is illustrated by the following Example.

EXAMPLE

The following ingredients were used:

| | |
|---|---|
| silica flour | 68% by weight |
| de-fibred bagasse | 15.2% by weight |
| phenol-formaldehyde resole resin | 8.4% by weight |
| 65% by weight aqueous p-toluene sulphonic acid | 4.2% by weight |
| methanol | 4.2% by weight |

The solid ingredients were thoroughly mixed together, the liquid ingredients blended together and the liquid blend then added to, and thoroughly mixed with, the solid mixture.

The mixture was put in a die and a pressure of 13.5 kg/sq.cm applied. When the resin was set, the mixture, in the form of a slab, was removed from the die.

The slab was of smooth uniform appearance and had a density of 0.68 g/cc and a modulus of rupture of 24 kg/cm$^2$.

The slab was tested in contact with molten steel and was found to emit little smoke or fume, to be resistant to penetration by the steel and to be easy to strip from the steel after the steel had solidified.

By varying the ratio of silica flour to de-fibred bagasse and/or the pressure applied, generally similar slabs but having different densities were made.

I claim:

1. In a shaped, refractory, heat-insulating article, for use in a metallurgical vessel, formed of a mixture comprising a particulate refractory material and a binder, the improvement comprising the inclusion of particulate de-fibred bagasse in said mixture.

2. An article according to claim 1 comprising 50 to 90% by weight particulate refractory material, 5 to 30% by weight of de-fibred bagasse and 3 to 10% by weight of binder.

3. A method of making an article according to claim 1, which method comprises forming the refractory material, de-fibred bagasse and binder into a mixture, shaping the mixture, subjecting the shaped mixture to pressure and allowing the binder therein to set.

4. An ingot mould having, in the head thereof, a lining comprising at least on article according to claim 1.

5. An ingot mould having, in a head box at the head thereof, a lining comprising at least one article according to claim 1.

6. A method of making a steel ingot comprising pouring molten steel into an ingot mould according to claim 4.

7. A method of making a steel ingot comprising pouring molten steel into an ingot mould according to claim 5.

* * * * *